US008502061B1

(12) United States Patent
Alt

(10) Patent No.: US 8,502,061 B1
(45) Date of Patent: Aug. 6, 2013

(54) ELECTRICAL STRINGED INSTRUMENT AND SIGNAL PROCESSING CIRCUIT THEREFOR

(76) Inventor: Andrew J. Alt, Los Angeles, CA (US)

( * ) Notice: Subject to any disclaimer, the term of this patent is extended or adjusted under 35 U.S.C. 154(b) by 0 days.

(21) Appl. No.: 13/428,915

(22) Filed: Mar. 23, 2012

Related U.S. Application Data

(60) Provisional application No. 61/467,240, filed on Mar. 24, 2011.

(51) Int. Cl.
*G10H 3/18* (2006.01)

(52) U.S. Cl.
USPC ..... 84/726; 84/725; 84/727

(58) Field of Classification Search
USPC ..... 84/723–734
See application file for complete search history.

(56) References Cited

U.S. PATENT DOCUMENTS

| | | | | | |
|---|---|---|---|---|---|
| 2,897,709 | A * | 8/1959 | McCarty et al. | 84/726 |
| 2,964,985 | A * | 12/1960 | Webster | 84/723 |
| 2,976,755 | A * | 3/1961 | Fender | 84/727 |
| 3,177,283 | A * | 4/1965 | Fender | 84/726 |
| 3,249,677 | A * | 5/1966 | Ormston Burns et al. | 84/726 |
| 3,290,980 | A * | 12/1966 | Fender | 84/307 |
| 4,377,101 | A * | 3/1983 | Santucci | 84/743 |
| 4,472,994 | A * | 9/1984 | Armstrong | 84/726 |
| 4,481,854 | A | 11/1984 | Dugas | |
| 4,483,233 | A * | 11/1984 | Benson | 84/263 |
| 5,189,241 | A * | 2/1993 | Nakamura | 84/728 |
| 5,723,805 | A * | 3/1998 | Lacombe | 84/727 |
| 5,796,025 | A * | 8/1998 | Haake | 84/464 R |
| 5,932,827 | A * | 8/1999 | Osborne et al. | 84/726 |
| 6,346,661 | B1 * | 2/2002 | Yaskoweak | 84/267 |
| 6,747,202 | B2 * | 6/2004 | Kuroki | 84/737 |
| 6,855,879 | B2 * | 2/2005 | Minakuchi et al. | 84/327 |
| 6,995,311 | B2 * | 2/2006 | Stevenson | 84/737 |
| 7,514,626 | B1 * | 4/2009 | Snyder | 84/733 |
| 7,799,986 | B2 * | 9/2010 | Ryle et al. | 84/737 |
| 7,812,243 | B2 * | 10/2010 | Celi et al. | 84/723 |
| 8,143,509 | B1 * | 3/2012 | Robertson et al. | 84/604 |
| 8,269,095 | B1 * | 9/2012 | Wallace | 84/726 |
| 2003/0106411 | A1 * | 6/2003 | Minakuchi et al. | 84/327 |
| 2004/0187673 | A1 * | 9/2004 | Stevenson | 84/737 |
| 2007/0227344 | A1 * | 10/2007 | Ryle et al. | 84/723 |
| 2008/0105101 | A1 * | 5/2008 | Eldring | 84/291 |
| 2009/0223353 | A1 * | 9/2009 | Loftus | 84/726 |
| 2010/0263521 | A1 * | 10/2010 | Ierymenko et al. | 84/726 |
| 2010/0275761 | A1 * | 11/2010 | Ierymenko | 84/731 |
| 2012/0125181 | A1 * | 5/2012 | Loftus | 84/726 |

* cited by examiner

*Primary Examiner* — David S. Warren
(74) *Attorney, Agent, or Firm* — Eckert Seamans Cherin & Mellott, LLC; Philip E. Levy

(57) ABSTRACT

A signal processing circuit allows a stringed instrument, like a guitar, to produce audio in an extended range. In the case of an electric guitar, the guitar can produce audio in an extended range including conventional lead and bass. An electric pickup for a stringed instrument includes an onboard rechargeable battery that modifies and boosts the signal produced by the pickup.

19 Claims, 9 Drawing Sheets

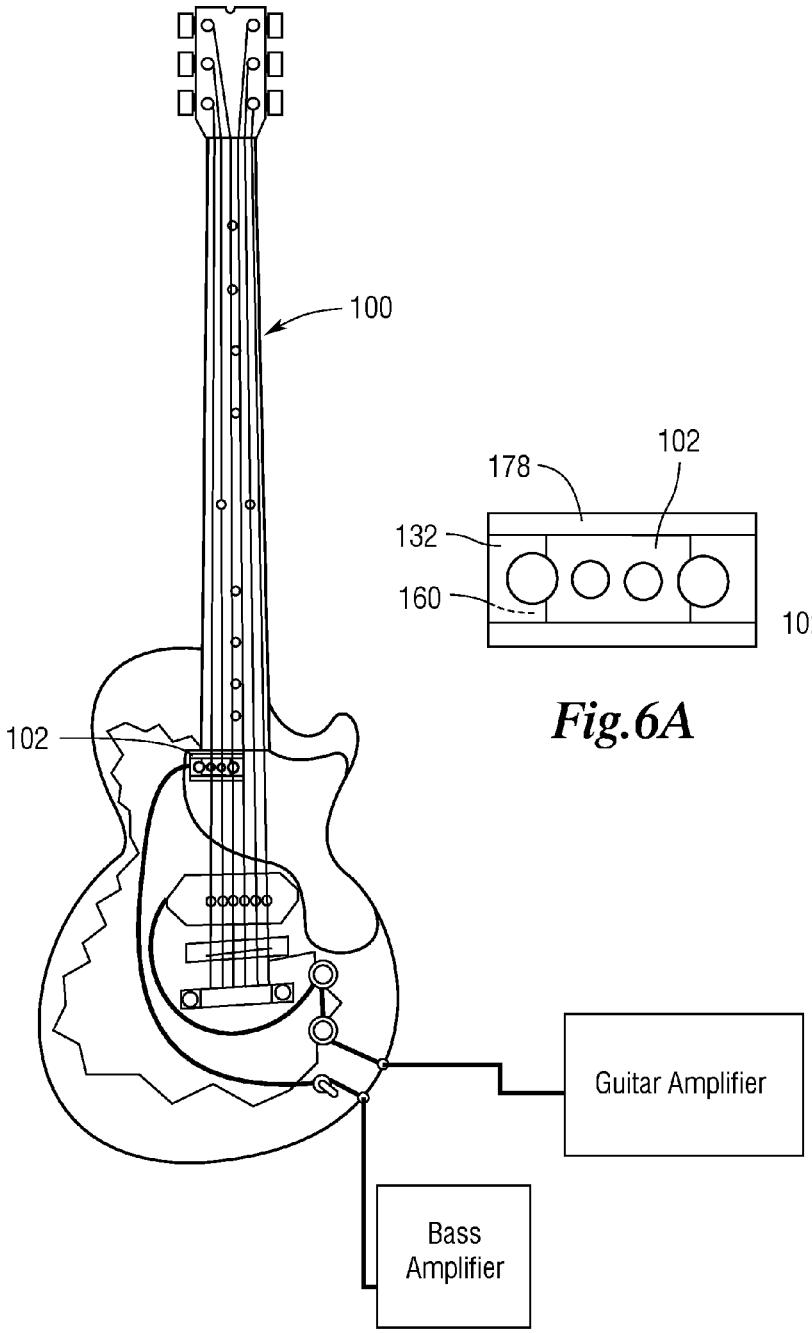
Fig.6A
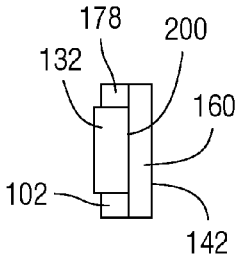
Fig.6B
Fig.6

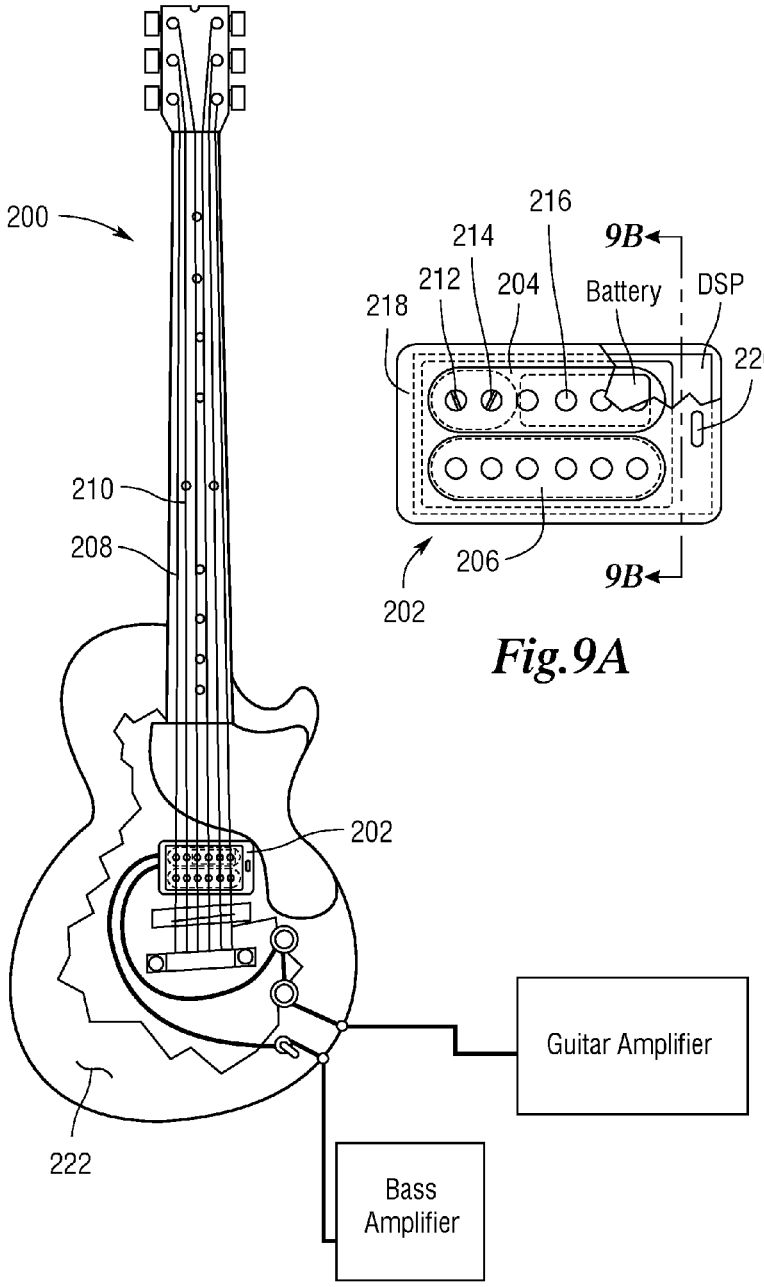
Fig.9A
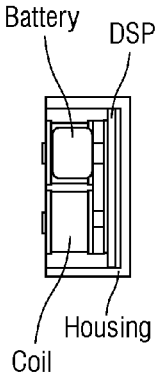
Fig.9B
Fig.10

ELECTRICAL STRINGED INSTRUMENT AND SIGNAL PROCESSING CIRCUIT THEREFOR

CROSS REFERENCE TO RELATED APPLICATIONS

This application claims the benefit of U.S. Provisional Application Ser. No. 61/467,240, filed Mar. 24, 2011, by the same inventor, the entire content of which is hereby incorporated by reference herein.

BACKGROUND OF THE INVENTION

The present invention relates to electrical stringed instruments and signal processing circuits therefor that produce audio in an extended audio range, and, more particularly, to a signal processing circuit that allows a stringed instrument to produce audio in two or more audio ranges, and an electrical stringed instrument employing the signal processing circuit.

Conventional stringed instruments have a limited audio range. For example, the conventional six string guitar has a limited tonal spectrum and is able to achieve sounds above the lowest open string (when tuned at standard "A 440 Hz" the lowest open string, "E"), which vibrates at 82.41 Hz when plucked.

In the case of conventional guitars, while there is typically some overlap in the audio ranges of a lead guitar and a bass guitar, the lead guitar cannot produce the range that the bass guitar can produce. Consequently, it is common for many types of bands or musical groups to include a musician who plays lead guitar, and a second musician who plays bass guitar.

An alternative would be to provide a guitar with the six strings used for a lead guitar, and additional low end strings that would extend the range of the guitar into the range of a bass guitar. This would allow one musician to play bass and lead on the same guitar. However, it would be difficult, if not impossible, for such a guitar to produce the sound that can be produced by conventional lead and bass guitars played by different musicians. This type of guitar would also be extremely difficult to play, due to the presence of more than six independent strings.

Another alternative, represented by U.S. Pat. No. 4,481,854, is to suppress certain frequencies produced by the strings of a lead guitar in an attempt to selectively lower the range of the strings. This does not, however, produce true bass, in that the range of the sound produced by the strings is not actually shifted into a new range.

Accordingly, there is the need for an electrical stringed instrument with an extended audio range that allows a single performer to produce audio in two or more ranges, preferably from the same string or strings. Similarly, there is the need for an electric guitar that allows a single musician to produce sound in both bass and lead ranges from the same strings of the guitar.

SUMMARY OF THE INVENTION

The present invention provides a signal processing circuit that permits an electric stringed instrument to produce audio in an extended range, and an electric stringed instrument that employs the signal processing circuit. The invention also includes a method for providing an electric stringed instrument that produces audio in an extended range, and for converting a conventional electric stringed instrument to one producing audio in an extended range. In the case of an electric guitar, the extended range can be the conventional audio range produced by a lead guitar, and at least part of the range produced by a conventional bass guitar.

The stringed instrument provided by the present invention can employ the same strings used by a conventional stringed instrument of the same type. For example, an electric lead guitar of the type provided by the present invention can have six strings. Though a guitar having more than six strings is also contemplated by the present invention, a six-string guitar is preferable because guitarists are already familiar with playing that type of guitar, and a guitar with six strings would be simpler to construct than one having more than six strings. Preferably, the two lowest of the six strings are used to produce the bass audio. Also preferably, these same two strings can simultaneously produce audio in the normal lead range produced by a lead guitar. In other words, the guitar can produce sound in the conventional lead guitar range from all six strings, and simultaneously produce audio in part of the bass guitar range from the lowest two strings. It is also possible to produce bass audio only, or lead audio only.

Though it is possible to use a single transducer, preferably the instrument employs at least a pair of transducers that produce signals corresponding to the vibration of one or more of the strings of the instrument. The transducers can be conventional electromagnetic pickups commonly employed with electric guitars and other electric stringed instruments. These pickups produce an analog electrical signal related to the frequency of vibration of the strings proximate the pickup. Preferably, when employed with an electric guitar, two pickups are provided. Both are conventional magnetic transducer pickups. One pickup is associated with all six strings of the guitar, and produces the signal that is fed to an amplifier to produce the conventional sound produced by a lead electric guitar. A second conventional pickup is mounted to the guitar proximate the lowest two strings of the guitar; the signals produced by this pickup are used to convert the vibration of these two strings to sound in the bass range.

The signal processing circuit provided by the present invention is associated with a transducer that produces a signal corresponding to the vibration of one or more of the strings of the instrument that is used to produce the extended audio range of the instrument. When it is employed in connection with an electric guitar, it is preferably associated with the lowest two strings of the instrument. The pickup produces electric signals from the vibrating strings in the conventional manner. However, unlike the signals produced by the "lead" pickup, which are fed through volume and tone controls to an amplifier, the "bass" signals are first fed to the signal processing circuit. Typically, these signals will, at the input to the signal processing circuit, still be substantially the same as the signals produced from these strings by the "lead" pickup. The bass signal processing circuit converts the signals to a digital signal, and inputs the digital signals to a digital signal processor ("DSP"), which alters the frequencies of the signals to frequencies associated with the desired bass range. Preferably, the DSP halves or quarters the frequency of the signals to shift the audio range downward by one or two octaves. However, the DSP can modify the signals to produce downward audio shifts of other magnitudes, as desired. The modified digital signals are then converted back to analog signals and input via a conventional ¼" instrument cable to the "bass" amplifier to produce bass audio. Again, these same strings can simultaneously, if desired, produce their normal lead audio via the "lead" pickup circuit.

The present invention contemplates production of a stringed instrument that includes the signal processing circuit. However, the present invention also contemplates retrofitting an existing, conventional stringed instrument to extend the audio range of the instrument with a completely newly designed and never seen before unit.

BRIEF DESCRIPTION OF THE DRAWINGS

The following detailed description of the preferred embodiment may be understood better if reference is made to the appended drawing, in which:

FIG. 6 shows another guitar provided by the present invention that employs a signal processing circuit provided by the present invention, in which part of the bass signal processing circuit is mounted beneath the bass pickup, and the battery surrounds the bass pickup;

FIG. 6A is a plan view of the pickup unit shown in FIG. 6;

FIG. 6B is a side view of the pickup unit shown in FIGS. 6 and 6A;

FIG. 9 is a view of a standard "humbucker" pickup that has been modified to serve as the unit that houses the lead and bass pickups and the rechargeable battery with the DSP Octaver attached;

FIG. 10 is a view of a guitar in which the unit shown in FIG. 9 has been mounted.

DETAILED DESCRIPTION OF THE PREFERRED EMBODIMENTS

While the present invention provides a signal processing circuit that permits any electric stringed instrument to produce audio in an extended range, and an electric stringed instrument that employs the signal processing circuit, the preferred embodiments will be described in the context of a lead guitar. While the description of the preferred embodiments describes a guitar constructed according to the teachings of the present invention, it also should be noted that the description encompasses a conventional lead guitar that has been retrofitted with the signal processing circuit to achieve a lead guitar with an extended audio range. In the preferred embodiments, the extended range is the conventional audio range produced by a lead guitar, and at least part of the bass audio range produced by a conventional bass guitar. In the case of both of the preferred embodiments described herein, the two lowest strings of the lead guitar are used to produce both the bass component of the extended range, and the lead component. Each of these components can be played alone or simultaneously. The two lowest notes on the lead guitar when tuned to standard tuning of "A 440 Hz" are the low "E" string and the "A" string. When the guitarist chooses to play the lead component, either alone or in combination with the bass component, the amplifier plays the lead sound typically produced by these strings. When plucked, these strings actually vibrate at 82.41 and 110. Hz, respectively. When the bass signal processing circuit is engaged, the frequencies of the electrical signals associated with these two lowest guitar strings are transformed one octave below, producing the exact frequencies found on the low "E" and "A" strings found on a bass guitar. Hence, the bass signal processing circuit, when engaged, converts the frequency of the signal associated with the "E" string to 41.20 HZ, and the signal associated with the "A" string to 55.00 Hz. The bass signal processing circuit permits the audio to be dropped an octave further. In that case, the frequency of the signal associated with the lowest "E" string becomes 20.60 Hz and the signal associated with the "A" string becomes 27.50 Hz. This is an octave below that of a conventional bass when tuned to the standard A=220 Hz pitch. Whether the entire bass range of a conventional bass guitar is produced, or only a part of the range is produced, is a matter of choice. The preferred embodiments described below use the lowest two strings of the guitar as the source of the bass audio. It is within the scope of the present invention to use any or all the strings of a guitar or other stringed instrument as the source of the extended component of the audio. Further, the preferred embodiments employ the same six strings provided for a conventional lead guitar. Other strings could be used, again, as a matter of choice.

Figure 1:
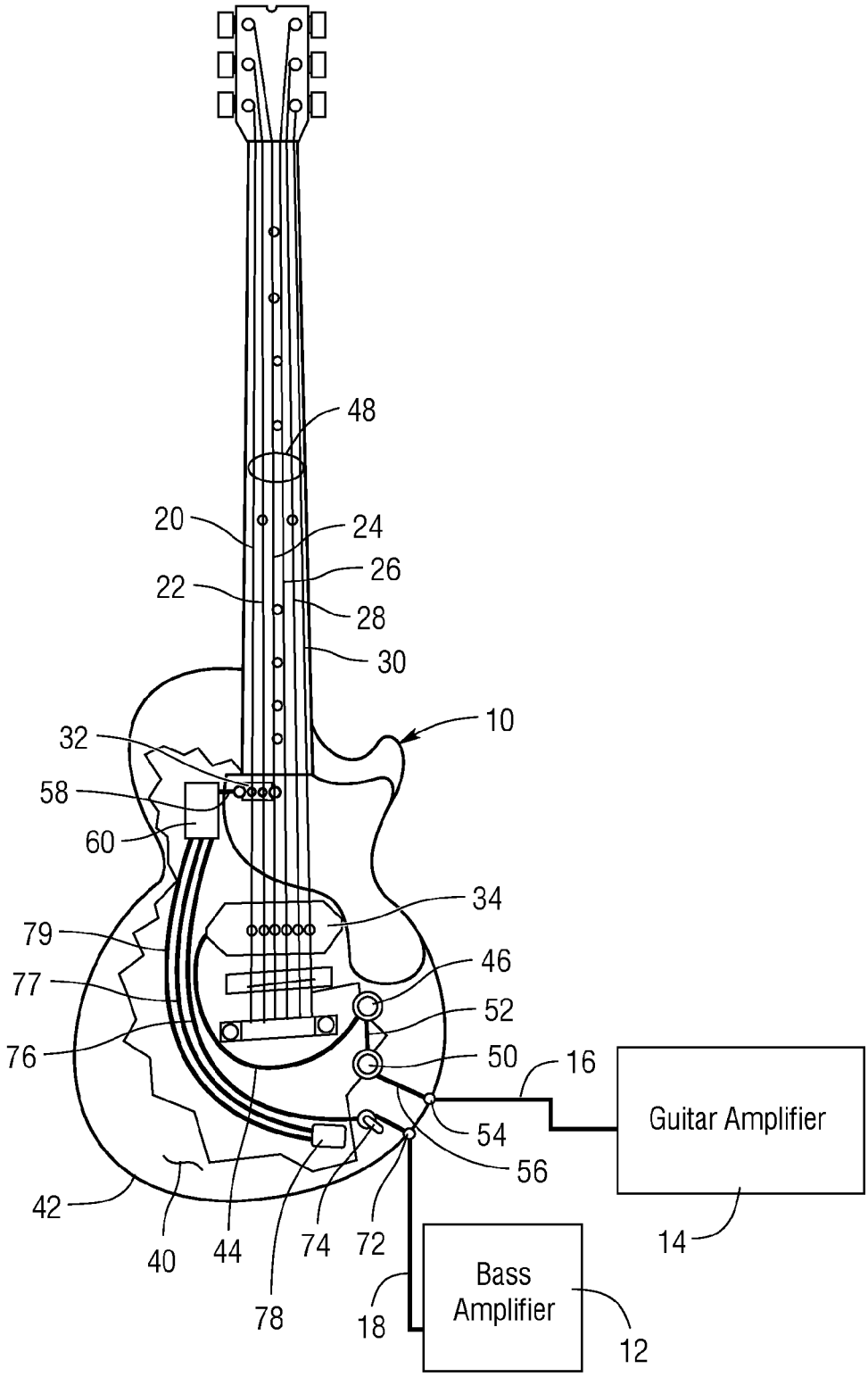
FIG. 1 shows a guitar provided by the present invention, which employs a signal processing circuit of the type provided by the present invention.
Figure 2:
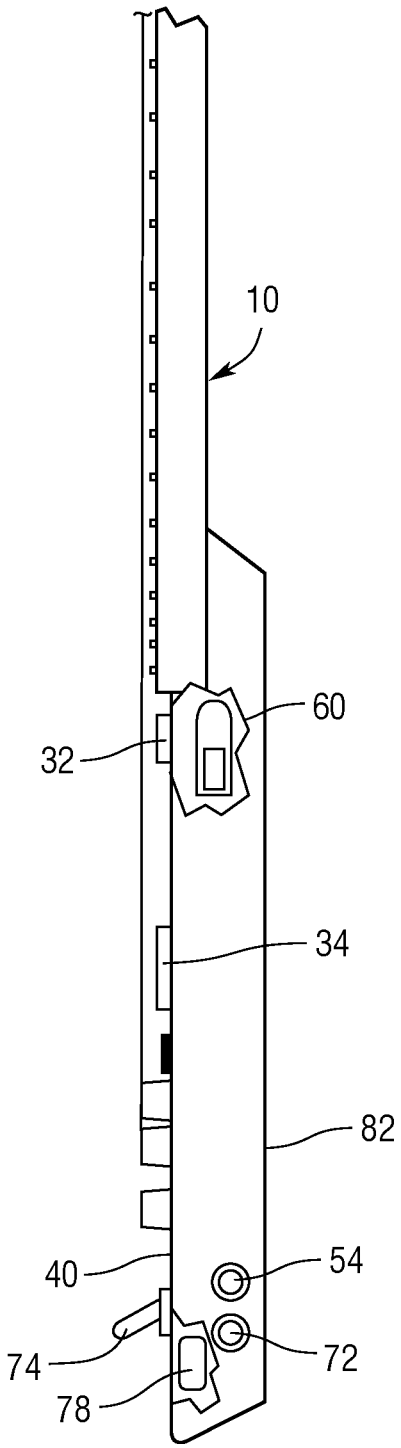
FIG. 2 is a side view of the guitar shown in FIG. 1.
Figure 3:
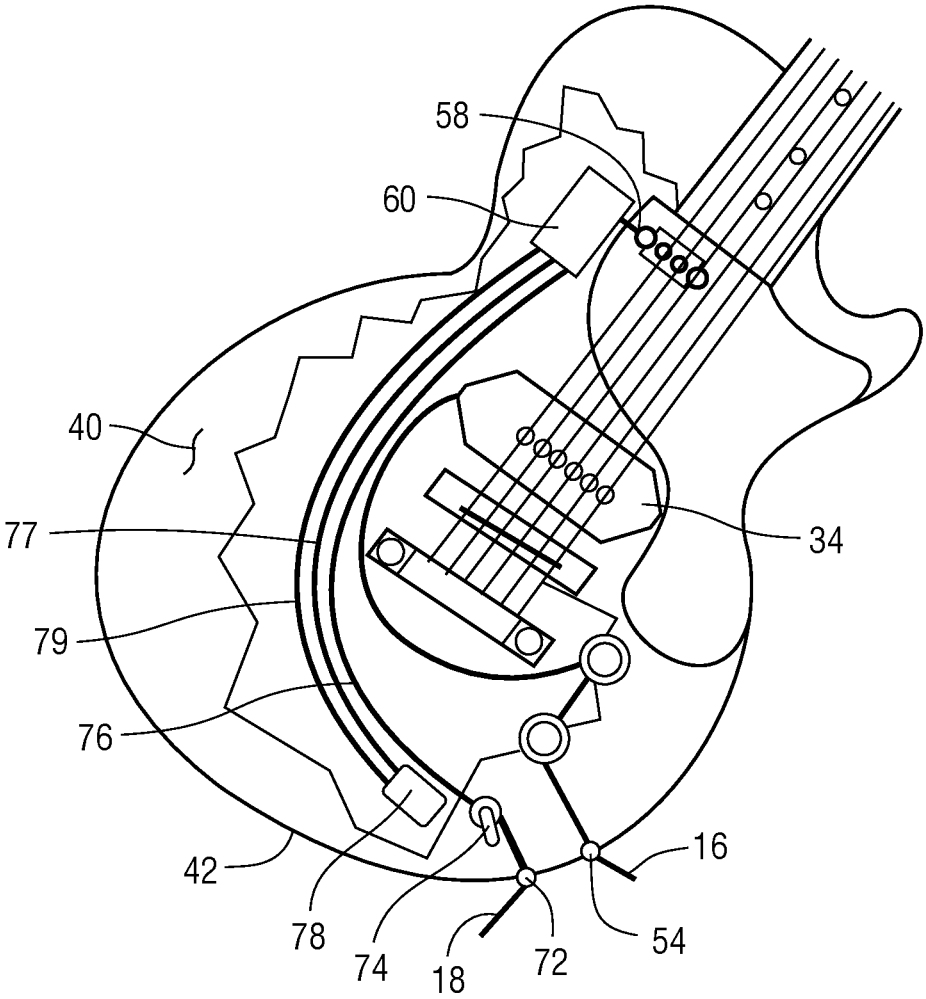
FIG. 3 is a view of a portion of the guitar shown in FIG. 1.
Figure 4:
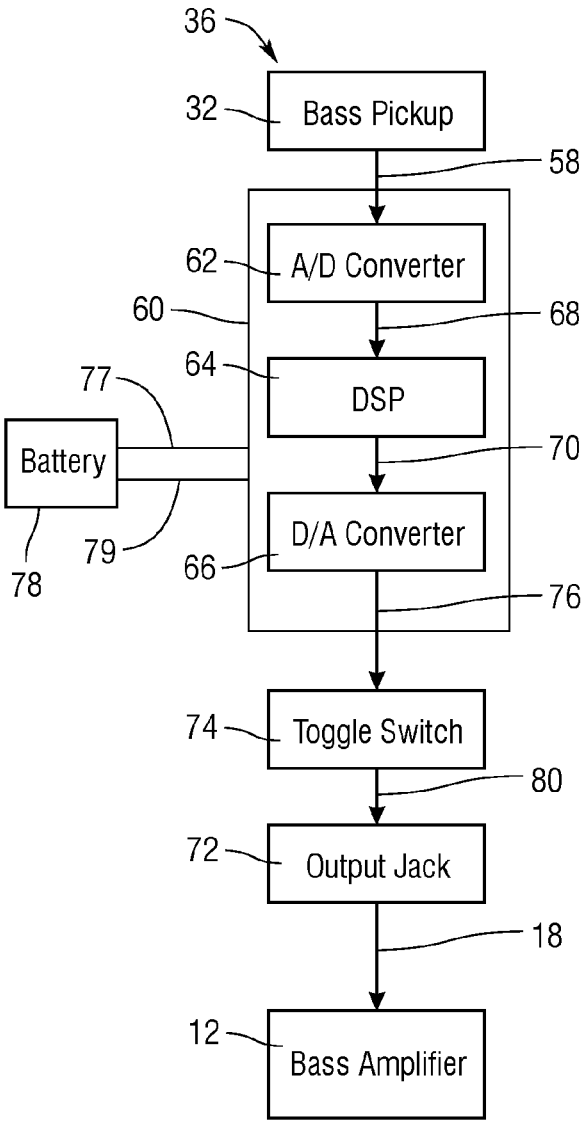
FIG. 4 shows the bass signal processing circuit provided by the present invention.
Figure 5:
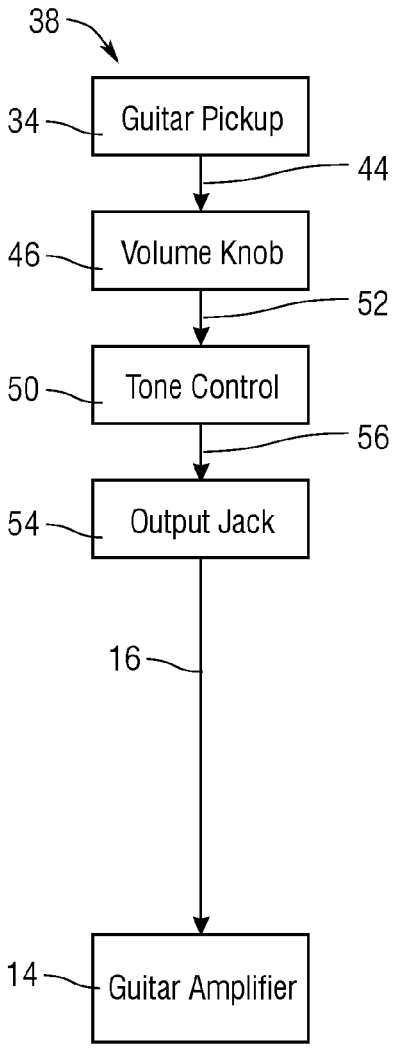
FIG. 5 shows the lead or guitar circuit provided by the present invention.
Figure 7:
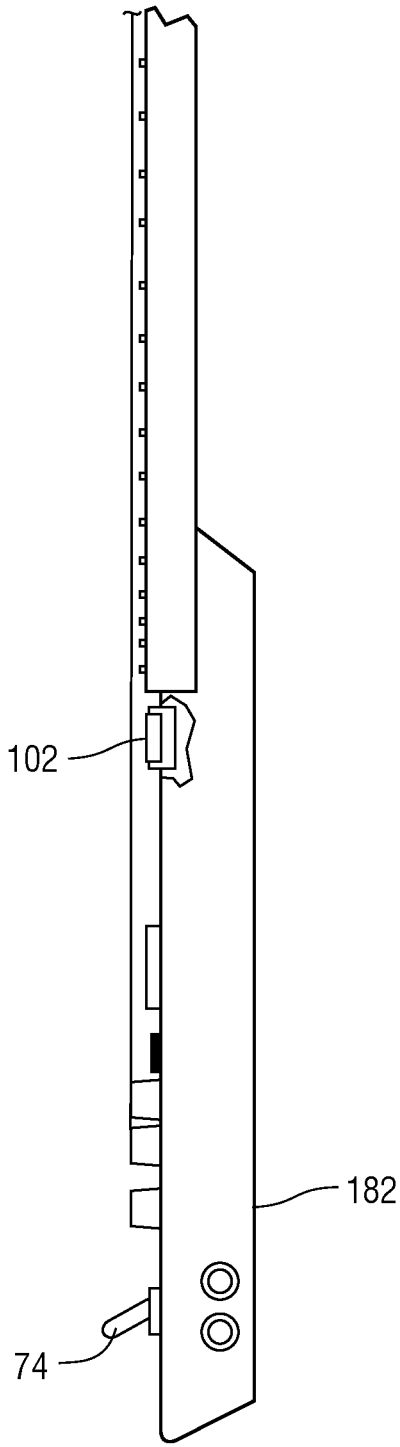
FIG. 7 is a side view of the guitar shown in FIG. 6.
Figure 8:
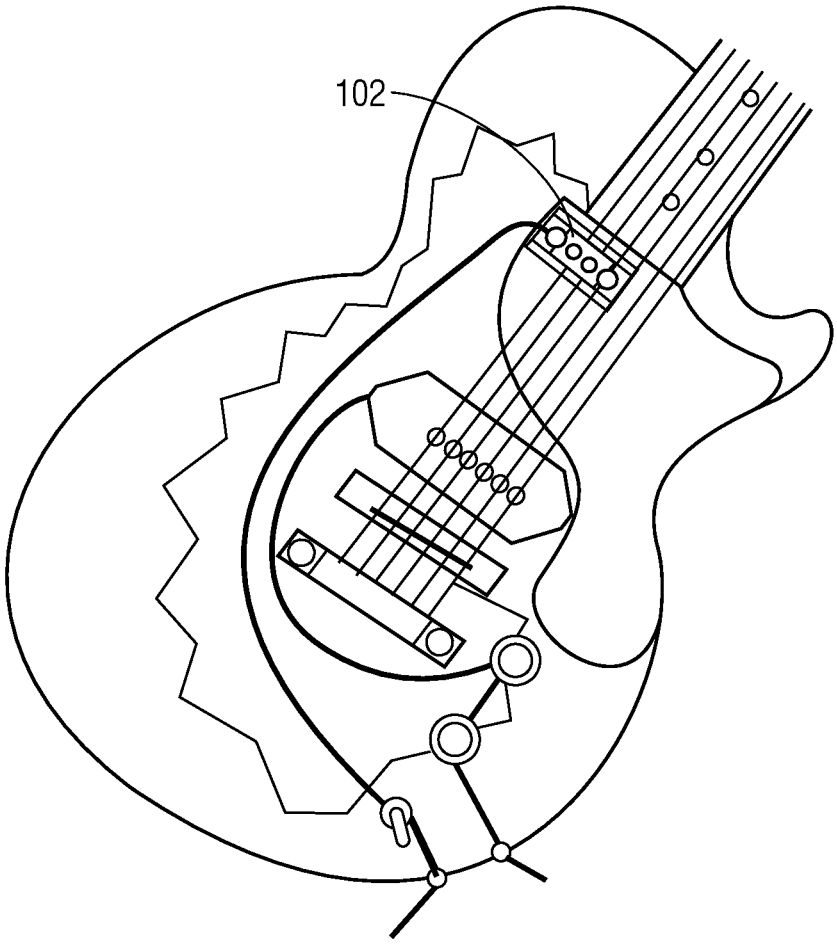
FIG. 8 is a view of a portion of the guitar shown in FIG. 6.
Figure 11:
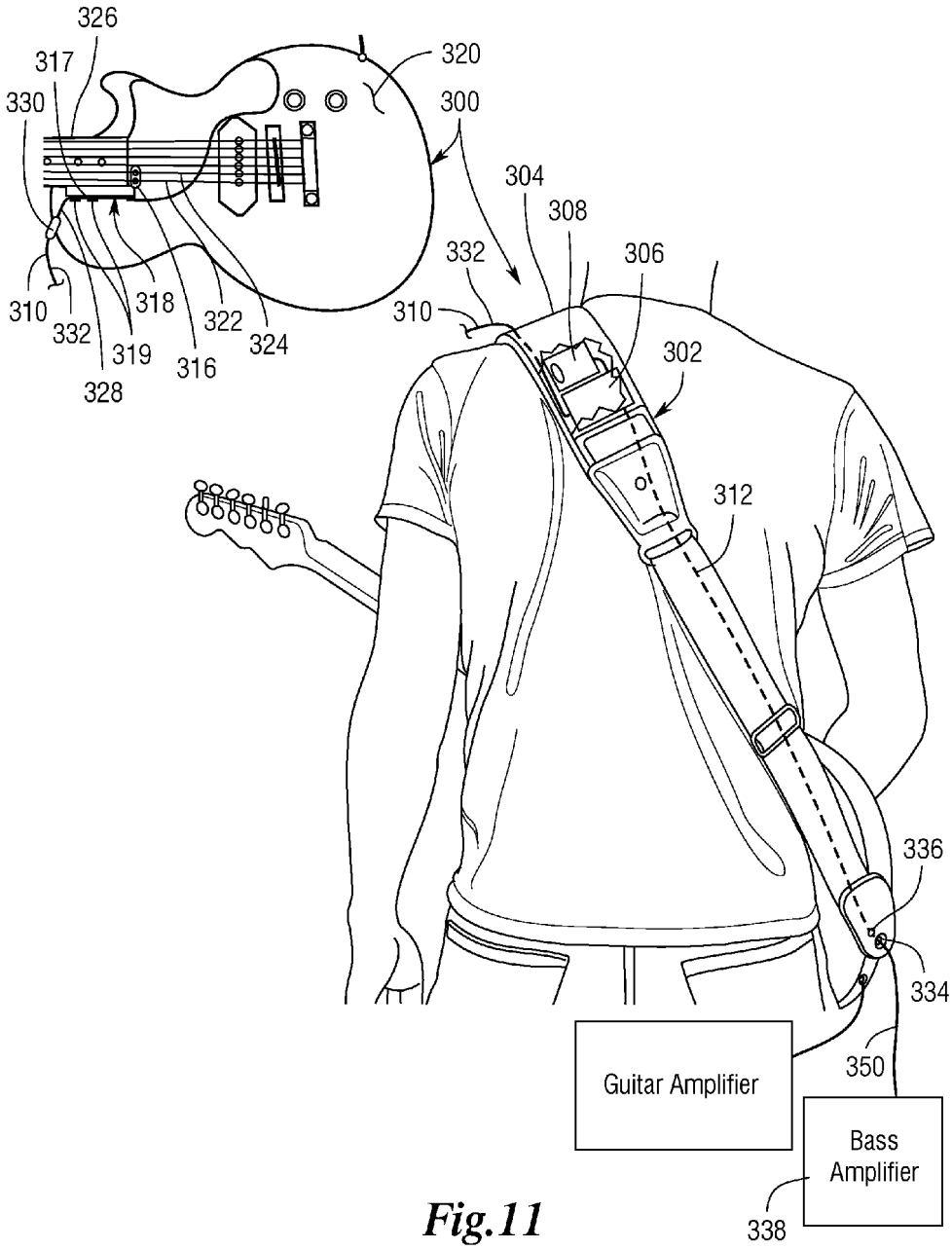
FIG. 11 shows another embodiment of the present invention in which the signal processing unit is housed in a guitar strap.

FIG. 1 shows a guitar 10 provided by the present invention, along with conventional bass amplifier 12 and lead guitar amplifier 14. Guitar 10 produces conventional lead guitar audio through guitar amplifier 14 when strings 48 of guitar 10 are played. Guitar 10 also employs a bass signal processing circuit of the type provided by the present invention, the preferred embodiment of which is shown in FIG. 4, to produce sound through bass amplifier 12 in the bass audio range. In this preferred embodiment, the conventional lead audio and bass audio constitute the extended audio range produced by guitar 10. Guitar 10 can produce lead audio only, bass audio only, or bass and lead audio together.

Guitar amplifier 14 receives electrical signals from guitar 10 along line 16 that are associated with the normal audio range provided by the six strings of guitar 10 when they are played. Amplifier 14 produces sound in this range in the conventional manner. A bass amplifier 12 receives electrical signals from guitar 10 along a conventional ¼" instrument cable 18 that are associated with bass audio produced by the bass signal processor circuit from the two lower strings 20 and 22 of guitar 10. In the preferred embodiment, as will be seen below, guitar 10 can produce lead and bass audio simultaneously from strings 20 and 22, or it can produce either lead or bass individually.

Guitar 10 employs a pair of conventional transducers that produce signals corresponding to the vibration of one or more of the strings 48 of guitar 10. Preferably, the transducers are a pair of conventional electromagnetic pickups 32 and 34 that are commonly employed with electric guitars and other stringed instruments. Each of pickups 32 and 34 produces in the well-known and conventional manner analog electrical signals related to the frequencies of vibration of the strings proximate the pickup. A first pickup 34 is associated with all six strings 48 of guitar 10, and produces the electrical signals that are fed to amplifier 14 to produce the conventional sound produced by a lead electric guitar. A second pickup 32 is mounted to guitar 10 below the two lowest strings 20 and 22 of guitar 10, which is used to convert the vibration of strings 20 and 22 to electrical signals that are used to create sound in the bass range.

Referring to FIGS. 1 through 5, guitar 10 includes bass signal processing circuit 36 and lead or guitar signal processing circuit 38. FIG. 1 is partially cut away to reveal a portion of the interior of guitar body 42 to show internal wiring of guitar 10. Lead or guitar processing circuit 38 (FIG. 5) is the conventional circuit employed in a convention lead guitar to produce amplified sound from the vibration of the six strings of the guitar. Pickup 34 is mounted to the upper surface 40 of guitar body 42 beneath strings 48. Pickup 34 produces electrical signals along line 44 to volume control 46 that are related to the frequencies of vibration of strings 48. Volume control 46 is conventional, and used to control the volume of sound produced through guitar amplifier 14. The signals are input from volume control 46 to tone control 50 along line 52. Tone control 50 and its conventional circuitry (not shown) are used by the musician playing guitar 10 to control the tone of the lead audio produced through guitar amplifier 14. The signal produced by tone control 50 is input to output jack 54 along line 56. Conventional ¼" instrument cable 16 is plugged into output jack 54 and guitar amplifier 14, along which the output signal from guitar 10 is input to guitar amplifier 14. Guitar amplifier 14 produces the conventional lead guitar sound produced by a lead electric guitar when its strings 48 are played.

Bass signal processing circuit 36 (FIG. 4) is the circuit that allows production of part or all the bass range produced by a conventional bass electric guitar. In the case of the preferred embodiment, the bass range is produced from the lowest two strings 20 and 22 of guitar 10. Either lead alone can be produced from strings 20 and 22, or bass and lead can be produced simultaneously from strings 20 and 22. Further, lead processing circuit 38 permits complete suppression of lead from strings 20 and 22 using lead volume control 46 to reduce the lead volume to zero, allowing strings 20 and 22 to produce bass sound only through guitar amplifier 12.

In particular, pickup 32 is mounted to the upper surface 40 of guitar body 42 beneath strings 20 and 22. Pickup 32 provides electrical signals along line 58 to a polyphonic octaver 60 the frequencies of which are related to the vibrations of strings 20 and 22. Polyphonic octaver 60 is a conventional, readily available processor that alters the frequencies of the electrical signals it receives using standard algorithms contained and selected by the user on octaver 60. A suitable octaver for this purpose is available from Boss/Roland Corporation, as Model No. OC-3 "Super Octave". In the case of the preferred embodiment, octaver 60 is used to halve or quarter the frequency of the signals received by octaver 60 from base pickup 32 to produce sound in the desired bass range.

Octaver 60 includes an analog to digital converter, or A/D converter, 62, a digital signal processor, or DSP, 64, which includes the signal modifying algorithms, and a digital to analog converter, or D/A converter, 66. A/D converter 62 receives the signals produced by bass pickup 32 along line 58. The signals on line 58 can be substantially the same as the signals on line 44 in lead signal processor circuit 38 produced by the vibration of strings 20 and 22. A/D converter 62 converts the analog signals on line 58 to digital signals, which are input to DSP 64 along line 68 (see FIG. 5). DSP 64 converts the frequencies of the signals on line 68 to the frequencies needed to produce bass audio in the desired range, using standard algorithms in DSP 64. DSP 64 inputs the converted digital signals to D/A converter 66 along line 70. D/A converter 66 converts the digital signals it receives back to analog signals, which are input to a conventional toggle switch 74 along line 76. Toggle switch 74 is used either to prevent the signals on line 76 to be input to bass amplifier 12 when it is desired not to produce bass audio, or to allow the signals on line 76 to be input to amplifier 12 when the production of bass audio is desired. When the guitarist wishes to produce bass only, volume control 46 can be adjusted to zero to completely eliminate lead audio. When the guitarist wishes to produce lead audio only, toggle switch 74 is moved to the "off" position to prevent production of bass audio. When switch 74 is in the "on" position, and volume control 46 is adjusted to a non-zero position, guitar 10 produces both bass audio and lead audio. A standard 9 volt battery 78 provides power to octaver 60 along lines 77 and 79. Battery 78 is a conventional alkaline or rechargeable 9 volt battery rated at 300-500 mAh and 9 volts.

Toggle switch 74 permits the musician to turn the bass audio on and off. When toggle switch 74 is in the "off" position, bass signal processing circuit 36 is "open", signals cannot flow from D/A converter 66 to output jack 72 in guitar body 42, and strings 20 and 22 do not produce bass audio through amplifier 12. When toggle switch 74 is in the "on" position, bass signals can flow from D/A converter 66 to output jack 72. Conventional cable 18 is plugged into output jack 72 and bass amplifier 12, along which the bass output signals from guitar 10 are input to bass amplifier 12 from jack 72. Bass amplifier 12 produces sound from these signals in the desired bass range when strings 20 and 22 are played.

A guitar 10 including a signal processing circuit 36 can be produced as a new product, or it can result from retrofitting a conventional lead guitar with a bass signal processing circuit 36. In either case, as shown in FIG. 1, octaver 60 can reside in a compartment formed within guitar body 42. A panel (not shown) in rear surface 82 of guitar body 42 provides access to octaver 60, cables 76, 77 and 79, and battery 78. To retrofit an existing guitar, the necessary interior of body 42 can be hollowed to form the compartment for octaver 60, cables 76, 77 and 79 and battery 78, and bass pickup 32, toggle switch 74 and jack 72 can be mounted in any conventional manner to body 42.

FIGS. 6, 6A, 6B, 7 and 8 show an alternate embodiment 100 of the present invention. Embodiment 100 is a guitar that is identical to guitar 100, with several exceptions. Components that are common to both guitar 10 and guitar 100 are designated by the same reference characters.

Guitar 100 is identical to guitar 10 with the exception of the location of the octaver 160 and the location and physical configuration of the lithium ion or lithium polymer battery 178, which are mounted to guitar 100 in a manner that differs from the mounting of the octaver 60 and battery 78 to guitar 10. As can be seen best in FIGS. 6, 6A, 6B and 7, a pickup unit 102 includes a battery 178, octaver 160 and bass pickup 132. Pickup 132 remains a conventional guitar pickup. Battery 178 is physically configured in any known manner to surround bass pickup 132. In this configuration, battery 178 also functions as the conventional collar employed in a convention pickup to aid in holding the pickup in place on a guitar. Similarly, octaver 160 is mounted beneath pickup 132, between the lower surface 200 of pickup 132 and the upper surface 142 of guitar 100. Suitable electrical connections are provided among pickup 132, octaver 160 and battery 178 in accordance with the teachings provided above. This configuration is simpler, and easier to implement. Battery 178 features a micro USB port on it, allowing it to be charged by a conventional AC wall charger operating at 110 volts in the US or 220 volts in the UK.

Another variation 200 includes an all-in-one pickup unit 202. Unit 202 is a modified "humbucker" sized pickup. Unit 202 takes the place of pickups 32 and 34 of guitar 10, and includes two pickups 204 and 206. Pickup 206 acts as the pickup that produces lead audio sound, serving the function of pickup 34 of guitar 10. Pickup 204 acts as the pickup that produces bass audio from strings 208 and 210. In particular, coils 212 and 214 are positioned below strings 208 and 210, and produce electrical signals that are associated with those two strings in the conventional way. Coils 216 are deactivated, and have no function. A micro USB connection 220 is formed in pickup ring 218 of unit 202, and is used as a means of charging a battery (not shown) that is mounted within unit 202 under dummy coils 216. An octaver (not shown) is mounted under unit 202 between the lower surface of unit 202 and the upper surface 222 of guitar 200. In all other respects, guitar 200 functions like guitars 10 and 100. Unit 202 is inserted into a cavity formed in guitar 200, just like a conventional "humbucker" sized pickup. The dummy coils or poles 216 house a battery that powers the DSP unit mounted below or embodied within the guitar 200. The pickup ring 218 around this configuration would feature a micro USB port 220, allowing the battery inside the dummy coils 216 to be recharged when not in use.

Yet another variation, 300, achieves the same result. An all-in-one guitar strap system unit 302 includes a conventional guitar strap 304 that has been modified to house Octaver DSP unit 306, a rechargeable battery 308 featuring a micro USB charge port, and wires 310 and 312. A floating two piece pole pickup unit 318 is also provided to produce the signals from strings 322 and 324 that are used to produce sound in the bass range. Floating pickup 318 is a standard, readily available unit that is typically used when it is not desired or not possible to route, drill and/or mount the pickup directly to or within the top surface of a guitar body. In the case of guitar 300, however, a floating pickup is used to facilitate providing the signal produced by the "bass pickup" to the electrical components provided in strap 304 of guitar 300.

Unit 318 includes a pickup 316 and a mounting 317. Pickup 316 is not mounted directly to the upper surface of guitar body 320. Rather, pickup 316 is secured to clip or mounting 317, which in turn is mounted to the side of neck 326 of guitar 300. Thus, mounting 317 fixes the position of pickup 316 beneath strings 322 and 324 of guitar 300. Pickup 316 itself is a conventional pickup similar in function to the previous versions identified above. However, unit 318 is what is commonly known in the guitar industry as a "floating pickup". Rather than being mounted directly to the body 320 of guitar 300, "floating pickup" unit 318 is mounted to the guitar through a metal clip or mounting 317, which is mounted with screws 317 into the side of the end of neck 326 of guitar 300, as opposed to being mounted into the body 320 of guitar 300. This pickup arrangement allows the entire pickup to "float" above the body 320 of guitar 300 but still be located under strings 322 and 324. Unit 318 functions just like the previously described bass pickups. The benefit of having pickup 316 located entirely above body 320 is that all associated wiring is visible and accessible above body 320 as well. Wiring 328 coming from pickup 316 and mounting 317 is wrapped once around conventional strap lock 330 on the guitar's body 320. Strap 304 is secured in the conventional manner to strap lock 330 of guitar body 320 when in use to mount that end of strap 304 to body 320., Shielded, flexible rubber tubing 332 surrounds wire 310, which is then fed into the top of the guitar strap 304. Wire 310 includes extra slack within the rubber tubing 332, allowing the guitar player to move freely while the instrument is in play. The wire 310 is then connected to the A/D converter of the Octaver 306 and then out of the D/A converter of the Octaver 306. The Octaver 306 is secured in one place within the strap 304 by being sewn into place on both sides of its location. Octaver 306 can be identical to and operate on the signals produced by pickup 316 in the way as the Octavers in guitars 10, 100 and 200. Wire 312 carries the modified signals produced by pickup 316 to bass amplifier 338.

Wire or cable 312 travels within strap 304 to a switch 336, which, as with the other embodiments, is used to provide or suppress audio in the bass range. The wire 312 travels from switch 336 to the bottom of the strap 304 where it is soldered to a conventional ¼" jack 334. From the jack 334, any conventional ¼" cable 350 can be used to connect wiring 312 to bass amplifier 338 to produce a bass tone.

What is claimed is:

1. An electrical stringed musical instrument comprising:

a plurality of strings;

first and second pickup circuits, said first pickup circuit being associated with a first set of said strings of said instrument and said second pickup circuit being associated with only a second set of said strings of said instrument, said second set being a subset of said first set;

said first pickup circuit being structured to produce a first electrical signal corresponding to a first audio range in response to vibration of one or more of the second set of said strings; and said second pickup circuit being structured to produce a second electrical signal corresponding to the first audio range in response to vibration of the one or more of the second set of said strings and including a signal processor structured to convert said second electrical signal into a third electrical signal corresponding to a second audio range different than said first audio range.

2. The instrument recited by claim 1 wherein said first set of said strings is all said strings of said instrument, and said second set of said strings is fewer than all said strings of said instrument.

3. The instrument recited by claim 1 wherein the instrument is structured to simultaneously produce said first electrical signal and said third electrical signal in response to vibration of the one or more of the second set of said strings.

4. The instrument recited by claim 1 wherein said first audio range is separated from said second audio range by one octave.

5. The instrument recited by claim 1 wherein said first audio range is separated from said second audio range by two octaves.

6. The instrument recited by claim 1 wherein said second pickup circuit includes a pickup.

7. The instrument recited by claim 6 wherein said signal processor comprises an analog-to-digital converter in communication with said pickup, a polyphonic octave digital signal processor in communication with said analog-to-digital converter, and a digital-to-analog converter in communication with said polyphonic octave digital signal processor.

8. A method of extending the range of an electrical stringed musical instrument having a plurality of strings and first and second pickup circuits, said first pickup circuit being associated with a first set of said strings of said instrument and said second pickup circuit being associated with only a second set of said strings of said instrument, said second set being a subset of said first set, the method comprising:

producing a first electrical signal corresponding to a first audio range in response to vibration of one or more of the second set of said strings using said first pickup circuit;

producing a second electrical signal corresponding to the first audio range in response to vibration of the one or more of the second set of said strings using said second pickup circuit; and converting said second electrical signal into a third electrical signal corresponding to a second audio range different than said first audio range using a signal processor of said second pickup circuit.

9. A pickup unit for a stringed instrument having a plurality of strings, comprising:

a housing structured to be attached to an exterior of a body of said stringed instrument beneath said strings;

a first electromagnetic pickup supported by the housing, said first electromagnetic pickup being structured to be associated with only a subset of said strings when said housing is attached to said stringed instrument, said first electromagnetic pickup being structured to generate a first electrical signal corresponding to a first audio range in response to vibration of one or more of said subset of said strings;

a second electromagnetic pickup supported by the housing, said second electromagnetic pickup being structured to be associated with all of said strings when said housing is attached to said stringed instrument, said second electromagnetic pickup being structured to generate a third electrical signal corresponding to the first audio range in response to vibration of the one or more of said subset of said strings;

a signal processor supported by the housing and coupled to said first electromagnetic pickup, said signal processor being structured to convert said first electrical signal into a second electrical signal corresponding to a second audio range different than said first audio range; and an energy storage device supported by the housing for providing power to said signal processor.

10. The pickup unit recited by claim 9, wherein the energy storage device is a rechargeable battery.

11. The instrument recited by claim 3 wherein the instrument is structured to selectively enable a first output signal based on the first electrical signal and a second output signal based on the third electrical signal to be output simultaneously and separately from the instrument for use in generating sound using the first output signal and the second output signal.

12. The instrument recited by claim 11 wherein the instrument is further structured to selectively enable only said first output signal based on the first electrical signal to be output from the instrument for use in generating sound using the first output signal.

13. The instrument recited by claim 11 wherein the instrument is further structured to selectively enable only said second output signal based on the third electrical signal to be output from the instrument for use in generating sound using the second output signal.

14. The method recited by claim 8 wherein said first electrical signal and said third electrical signal are produced simultaneously in response to vibration of the one or more of the second set of said strings.

15. The method recited by claim 14 further comprising simultaneously and separately outputting a first output signal based on the first electrical signal and a second output signal based on the third electrical signal from the instrument for use in generating sound using the first output signal and the second output signal.

16. The pickup unit recited by claim 9 wherein the pickup unit is structured to simultaneously produce said second electrical signal and said third electrical signal in response to vibration of the one or more of said subset of said strings.

17. The pickup unit recited by claim 9 further comprising a recharging port supported by said housing and coupled to said energy storage device.

18. The instrument recited by claim 2 wherein said instrument is a guitar, wherein said first set of said strings is all said strings of said guitar, and wherein said second set of said strings is a low E string and an A string of said guitar.

19. The pickup unit recited by claim 9 wherein said instrument is a guitar, wherein said subset of said strings is a low E string and an A string of said guitar.

* * * * *